US011285589B2

(12) United States Patent
Chiang et al.

(10) Patent No.: US 11,285,589 B2
(45) Date of Patent: Mar. 29, 2022

(54) SOCKET

(71) Applicant: SHIN YING ENTPR CO., LTD., Taichung (TW)

(72) Inventors: Wen-Hung Chiang, Taichung (TW); Katsumi Osafune, Miki (JP)

(73) Assignee: SHIN YING ENTPR CO., LTD., Taichung (TW)

( * ) Notice: Subject to any disclaimer, the term of this patent is extended or adjusted under 35 U.S.C. 154(b) by 210 days.

(21) Appl. No.: 16/734,180

(22) Filed: Jan. 3, 2020

(65) Prior Publication Data

US 2020/0139522 A1 May 7, 2020

Related U.S. Application Data

(63) Continuation-in-part of application No. 15/819,826, filed on Nov. 21, 2017, now abandoned.

(51) Int. Cl.
*B25B 23/00* (2006.01)
*B25B 13/06* (2006.01)

(52) U.S. Cl.
CPC ..... *B25B 23/0035* (2013.01); *B25B 13/06* (2013.01)

(58) Field of Classification Search
CPC ..... B25B 23/0035; B25B 13/06
USPC ..... 81/121.1; 279/82; 403/127, 325
See application file for complete search history.

(56) References Cited

U.S. PATENT DOCUMENTS

| | | | | |
|---|---|---|---|---|
| 3,260,541 | A * | 7/1966 | Sadler | F16D 1/116 403/325 |
| 4,162,746 | A | 7/1979 | Anderson et al. | |
| 4,900,202 | A | 2/1990 | Wienhold | |
| 7,175,185 | B2 * | 2/2007 | Chen | B25B 15/001 279/75 |
| 8,132,990 | B2 | 3/2012 | Bauman | |
| 8,342,061 | B2 | 1/2013 | Super | |
| 8,366,122 | B2 | 2/2013 | Lee et al. | |
| 10,052,696 | B2 * | 8/2018 | Homola | B23B 31/22 |
| 2003/0056625 | A1 | 3/2003 | Bizilia et al. | |
| 2007/0290458 | A1 | 12/2007 | Chuang | |
| 2015/0143966 | A1 | 5/2015 | Pischke et al. | |

FOREIGN PATENT DOCUMENTS

| | | |
|---|---|---|
| TW | I366501 B | 6/2012 |
| TW | M464273 U | 11/2013 |

* cited by examiner

*Primary Examiner* — Hadi Shakeri
(74) *Attorney, Agent, or Firm* — Muncy, Geissler, Olds & Lowe, P.C.

(57) ABSTRACT

A socket is provided, including a socket main body, a switch member and at least one positioning unit. The socket main body has a working portion and a sleeve portion which are disposed along an extending direction of an axis, and the sleeve portion has a receiving space which is for the inserting portion of a driving tool to insert thereinto; the switch member is movable along the extending direction, disposed to the sleeve portion, and rotatable about the axis; the at least one positioning unit includes a first receiving portion penetrating through the sleeve portion and being lateral to the axis, a second receiving portion formed on the switch member and facing the sleeve portion, and a positioning member movably received in the first receiving portion, and a part of the positioning member protrudes beyond the first receiving portion.

1 Claim, 5 Drawing Sheets

SOCKET

The present invention is a CIP of application Ser. No. 15/819,826, filed Nov. 21, 2017, the entire contents of which are hereby incorporated by reference.

BACKGROUND OF THE INVENTION

Field of the Invention

Description of the Prior Art

Usually, a socket is used to cooperate with a driving tool (for example, a wrench, a pneumatic tool, an electronic tool) to twist fastening members like screws, bolts or nuts, and the socket is also used to disassemble objects like a spark plug. The major advantage of the socket is that it can extend to a narrow space and that a force can apply to the fastening member evenly to prevent over abrasion. Therefore, the socket is widely used in maintenance plant, inspection plant and assembling plant, and the type of sockets are disclosed in TWM 464273 and TWI366501.

In TWM 464273, the socket is assembled to an inserting portion of a driving tool through a positioning ball which is retractable and provided on the inserting portion of the driving tool, through inserting the inserting portion into the socket, the positioning ball is engaged and positioned with a recessive hole on an inner wall of the socket. However, in this way, the positioning ball and the inner wall of the socket are easily abraded, and the socket may be unable to be connected to the inserting portion stably and get loose easily.

In TWI 366501, the inserting portion of the driving tool has a through hole, after the socket is sleeved to the inserting portion, a restricting hole of the socket corresponds to the through hole, and a pin is inserted through the restricting hole of the socket and the through hole of the inserting portion so as to connect the socket and the inserting portion. However, in this way, an assembling process is more complex, and because the pin may get lost easily, a user may need to find alternatives to replace the pin and waste extra time.

In U.S. Pat. No. 8,132,990, the capping ring 9512 is formed with an annular groove 9506 on an inner surface thereof, and thus it is hard to process/manufacture. It is noted that if axial movement of the capping ring 9512 relative to the housing 9501 occurs, the ball 9504 can radially correspond to any of positions of the annular groove 9506 and can retract back into any of regions of the annular groove 9506, such that the ball 9504 can inadvertent disengage from the inserting portion of a driving tool easily and it can cause inadvertent danger to the user easily.

In US20030056625, the tubular attachment 20 has a non-circular driven bore 70 configured for mating with and receiving a non-circular drive portion 40 of an output shaft 10. That is, for natural function, the tubular attachment 20 and the output shaft 10 must be co-rotatable without relative rotation; otherwise, the tubular attachment 20 cannot be used to drive members such as bolts, screws, nuts or the like, which is unworkable.

The present invention has arisen to mitigate and/or obviate the afore-described disadvantages.

SUMMARY OF THE INVENTION

The major object of the present invention is to provide a socket, which is easy for a user to operate and can be quickly sleeved to an inserting portion of a driving tool. In addition, a positioning member is designed to be movably positioned in a socket main body so that the inserting portion can be prevented from being abraded during insertion.

To achieve the above and other objects, a socket is provided for being sleeved to an inserting portion of a driving tool, at least one positioning portion is recessed on the inserting portion, and the socket includes a socket main body, a switch member and at least one positioning unit. The socket main body has an axis and a working portion and a sleeve portion which are disposed along an extending direction of the axis, the working portion is for being connected to a fastening member, and the sleeve portion has a receiving space which is for the inserting portion to insert thereinto; the switch member is movable along the extending direction of the axis, disposed to the sleeve portion, and rotatable about the axis; the at least one positioning unit includes a first receiving portion, a second receiving portion and a positioning member, the first receiving portion penetrates through the sleeve portion and is lateral to the axis, the second receiving portion is formed on the switch member and faces the sleeve portion, the positioning member is movably received in the first receiving portion, and a part of the positioning member protrudes beyond the first receiving portion; when the switch member is on a locked position, the first receiving portion and the second receiving portion offset relative to each other, and the switch member makes a part of the positioning member protrude beyond the receiving space for positionably engaging with the positioning portion; and when the switch member is on a released position, the first receiving portion and the second receiving portion overlap with each other completely on a direction lateral to the axis, and a part of the positioning member protrudes within the second receiving portion without protruding within the receiving space.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
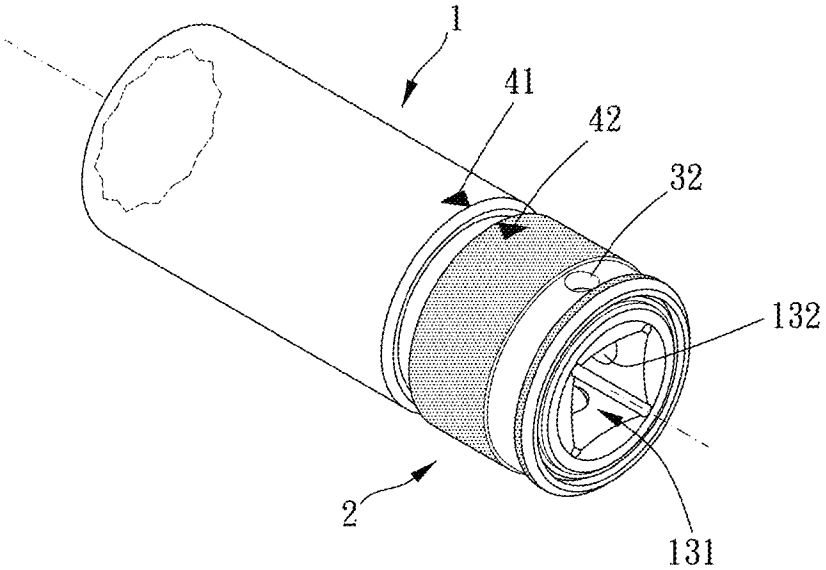
FIG. 1 is a stereogram of an embodiment of the present invention.
Figure 2:
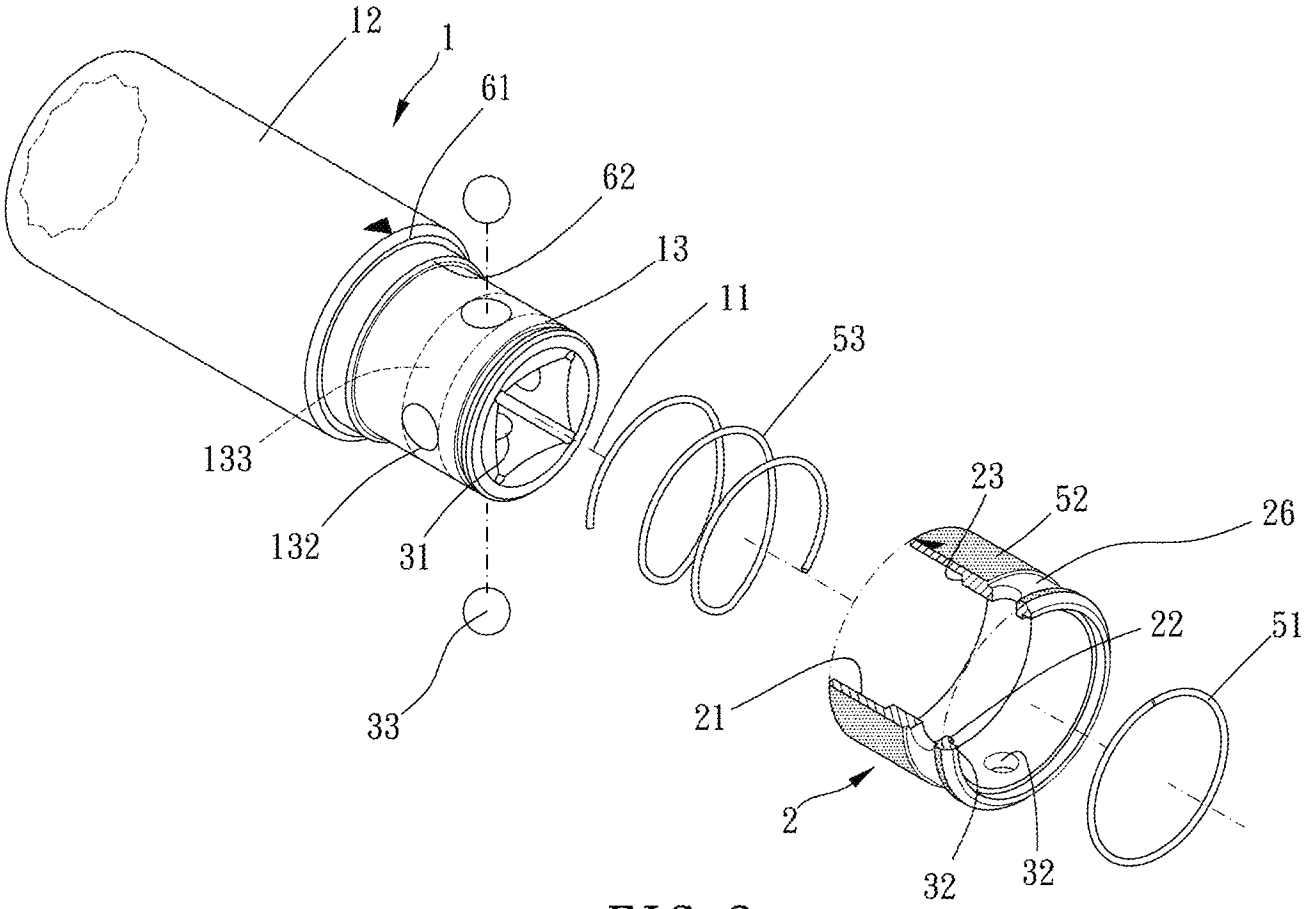
FIG. 2 is a breakdown view of FIG. 1.
Figure 3:
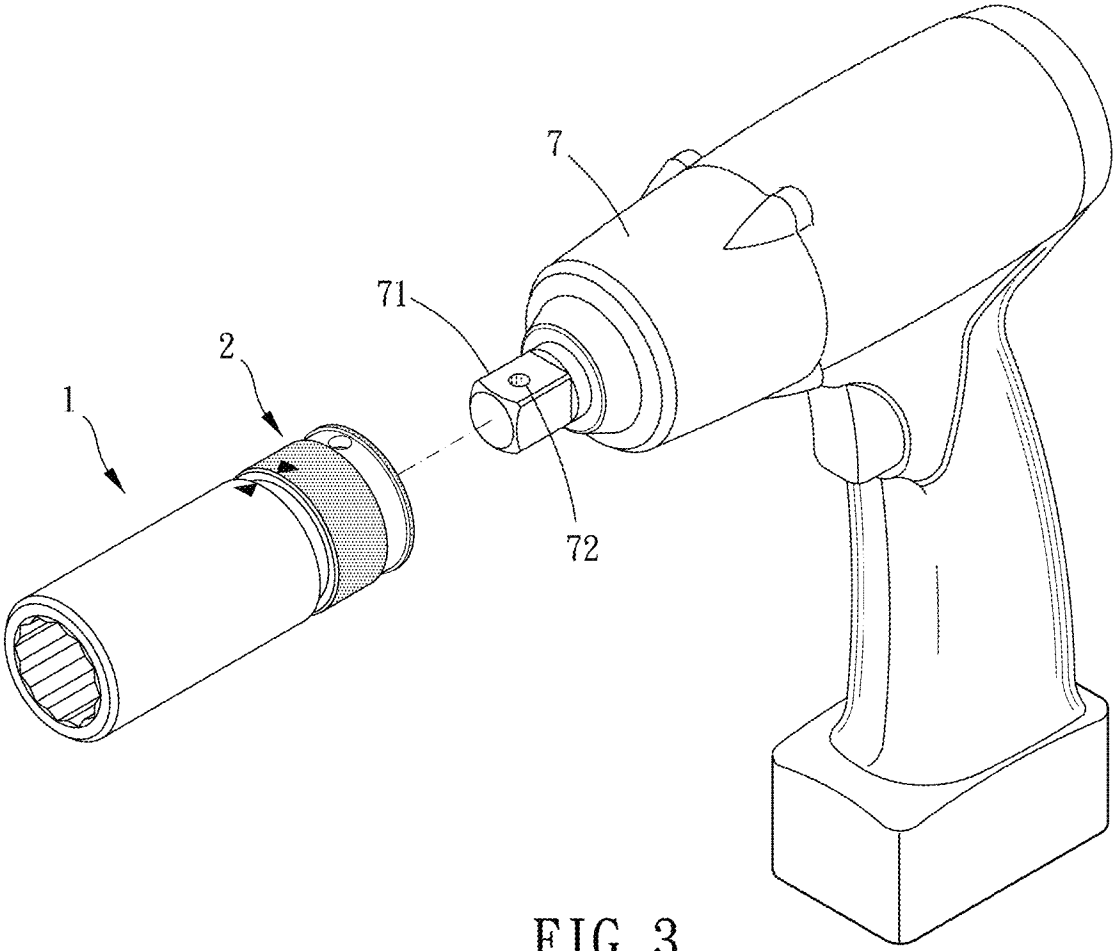
FIG. 3 is a drawing showing the present invention being assembled to a driving tool.
Figure 4:
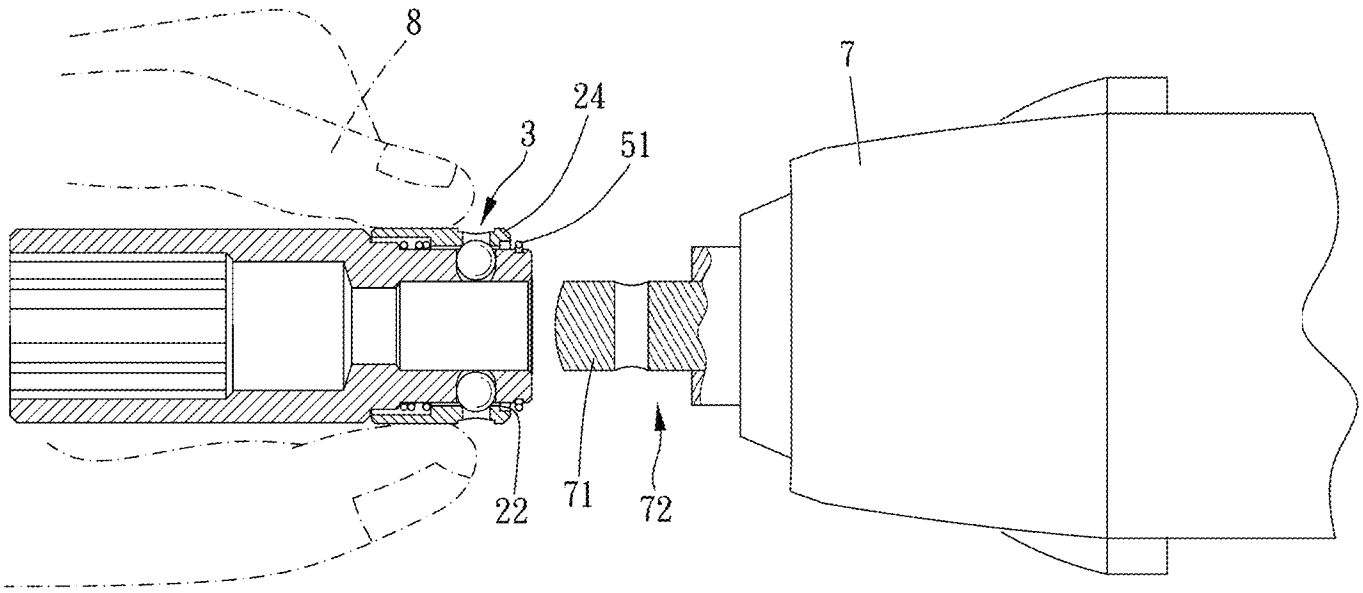
FIGS. 4 and 5 are drawings showing an assembling process.
Figure 5:
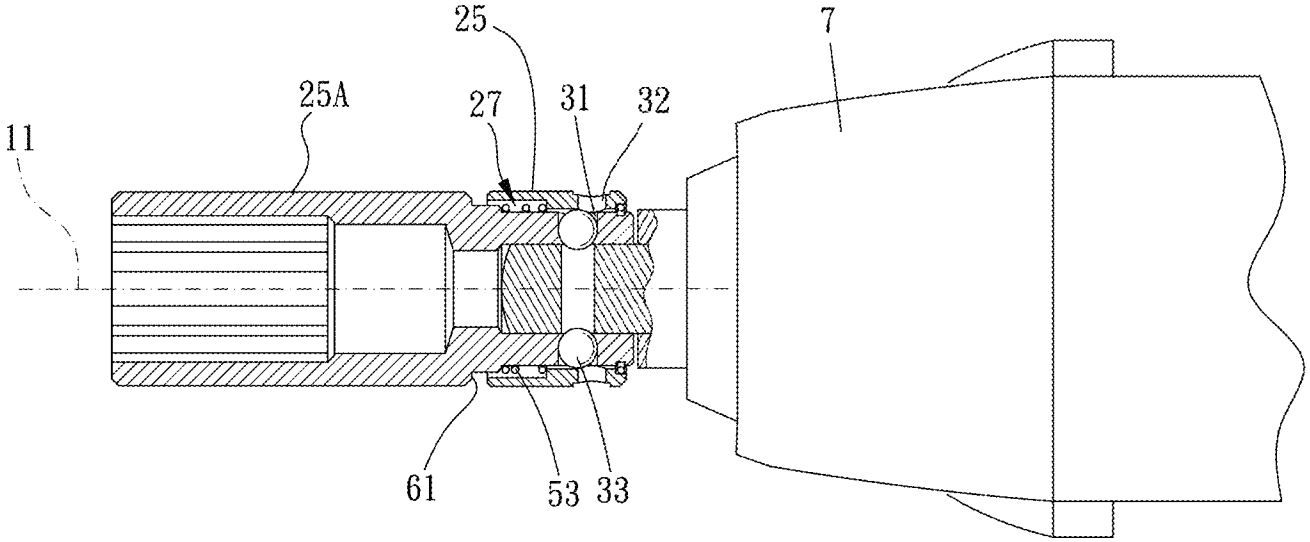

Please refer to FIGS. 1 to 5 for an embodiment of the present invention. A socket is provided for being sleeved to an inserting portion 71 of a driving tool 7, at least one positioning portion 72 is recessed on the inserting portion 71, and the socket includes a socket main body 1, a switch member 2 and at least one positioning unit 3.

The socket main body 1 has an axis 11 and a working portion 12 and a sleeve portion 13 which are disposed along an extending direction of the axis 11, the working portion 12 is for being connected to a fastening member (for example, a screw, a bolt or a nut), the sleeve portion 13 has a receiving space 131 which is for the inserting portion 71 to insert thereinto. The switch member 2 is movable along the extending direction of the axis 11, disposed to the sleeve portion 13, and rotatable about the axis 11.

In this embodiment, on the direction parallel to the axis 11, a length of the sleeve portion 13 is substantially 0.4 to 0.6 times of a length of the working portion 12 so that a user can easily operate with hand. In addition, the switch member 2 is sleeved to the sleeve portion 13, and a distance between an exterior circumferential wall 25 of the switch member 2 to the axis 11 is substantially equal to a distance between an exterior circumferential wall 25A of the working portion 12 to the axis 11. Since the switch member and the working portion are in similar dimensions, it is convenient for the user to store them. Of course, in other embodiments, the user can change the dimensions according to various requirements.

The at least one positioning unit 3 includes a first receiving portion 31, a second receiving portion 32 and a positioning member 33, the first receiving portion 31 penetrates through the sleeve portion 13 and is lateral to the axis 11, the second receiving portion 32 is formed on the switch member 2 and faces the sleeve portion 13, the positioning member 33 is movably received in the first receiving portion 31, and a part of the positioning member 33 protrudes beyond the first receiving portion 31. In this embodiment, the positioning member 33 is a ball, the first and second receiving portions 31, 32 are respectively a through hole, and the second receiving portion 32 is smaller than the first receiving portion 31 in hole dimension to prevent the positioning member 33 from falling off. It is understandable that in other embodiments, the second receiving portion may be a groove.

When the switch member 2 is on a locked position, the first receiving portion 31 and the second receiving portion 32 offset relative to each other, on a direction lateral to the axis 11, the switch member 2 covers an opening of the first receiving portion 31 to press the positioning member 33, and the switch member 2 makes a part of the positioning member 33 protrude into the receiving space 131 for positionably engaging with the positioning portion 72 so that the socket can be sleeved to the inserting portion 71. When the switch member 2 is on a released position, the first receiving portion 31 and the second receiving portion 32 overlap with each other completely on the direction lateral to the axis 11; therefore, when the positioning member 33 receives a force from the receiving space 131, a part of the positioning member 33 protrudes within the second receiving portion 32 without protruding within the receiving space 131 so that the positioning portion 72 is disengaged from the positioning member 33, and the inserting portion 71 can be pulled away from the receiving space 131.

In this embodiment, a number of the at least one positioning portion 72 is two, the two positioning portions 72 are openings which are symmetrical to each other and communicable with each other, a number of the at least one positioning unit 3 is two, the two positioning units 3 are symmetrical to each other with the axis 11 as a center, and when the switch member 2 is on the locked position, two said positioning members 33 are respectively engaged into the two positioning portions 72.

It is to be noted that since the switch member 2 can rotate relative to the socket main body 1 and move axially, through the two forms of movements, there can be more dislocation modes of the first receiving portion 31 and the second receiving portion 32 so that the switch member 2 will not be impacted by an unexpected force and misplaced to the released position. Instead, the switch member 2 can only be operated and moved to the released position by the user. Therefore, the socket can be connected to the inserting portion 71 more stably and will not fall off easily.

Specifically, the socket further includes a position-restricting member 51, the position-restricting member 51 is positioned on the sleeve portion 13 (in this embodiment, the position-restricting member 51 is a ring which is fastened on the sleeve portion 13), the working portion 12 is greater than the sleeve portion 13 in outer diameter dimension, and a first stepped portion 61 is formed between the working portion 12 and the sleeve portion 13; on the direction parallel to the axis 11, the first stepped portion 61 and the position-restricting member 51 have a predetermined distance therebetween, and the switch member 2 is positioningly restricted between the first stepped portion 61 and the position-restricting member 51. It is understandable that the predetermined distance is greater than a length of the switch member 2 on the direction parallel to the axis 11 so that the switch member 2 is slidable along the axis 11.

More specifically, two opposite sides of the switch member 2 have a first abutting portion 21 and a second abutting portion 22, the first abutting portion 21 is a part of an inner circumferential wall of the switch member 2, and the second abutting portion 22 is a flange integrally protruding radially on the inner circumferential wall. In the direction parallel to the axis 11, the first abutting portion 21 is located between the second abutting portion 22 and the first stepped portion 61. After the switch member 2 is rotated to allow the first receiving portion 31 to be linearly arranged relative to the second receiving portion 32 on the direction parallel to the axis 11, when the first abutting portion 21 abuts against the first stepped portion 61, the switch member 2 is on the released position, and when the second abutting portion 22 abuts against the position-restricting member 51, the switch member 2 is on the locked position.

In addition, in order to let the user know if the first receiving portion 31 and the second receiving portion 32 are on the same straight line, the socket main body 1 has a first marking portion 41, and the first marking portion 41 corresponds to the first receiving portion 31 on the direction parallel to the axis 11, the switch member 2 has a second marking portion 42, and the second marking portion 42 corresponds to the second receiving portion 32 on the direction parallel to the axis 11. Therefore, if the user wants to know whether the first receiving portion 31 and the second receiving portion 32 are on the same straight line, the user only needs to see if the first marking portion 41 is aligned with the second marking portion 42.

Preferably, the sleeve portion 13 further has a second stepped portion 62, the switch member 2 further has a base portion 23, and two ends of the elastic member 53 respectively abut against the second stepped portion 62 and the base portion 23 to make the second abutting portion 22 move toward the position-restricting member 51 normally. Therefore, after a force is removed from the switch member 2, the switch member 2 can quickly and automatically move to the locked position, and the socket can be quickly assembled to the inserting portion 71. At this moment, the switch member 2 can be further rotated to make the first receiving portion 31 and the second receiving portion 32 not on the same straight line to prevent slippery. In addition, the elastic member 53 can further provide a support to the switch member 2 so that the switch member 2 will not move due to an unexpected force.

More preferably, the switch member 2 further has a cover portion 24, the cover portion 24 is integrally protruding axially from the second abutting portion 22 and forms a stepped configuration with the second abutting portion 22. When the second abutting portion 22 abuts against the position-restricting member 51, the cover portion 24 covers the position-restricting member 51 on a direction lateral to the axis 11 to separate objects from outside and the position-restricting member 51. Therefore, a structural integrity of the position-restricting member 51 can be kept, and the position-restricting member 51 can be stably and firmly positioned on the sleeve portion 13.

Similarly, the first abutting portion 21 is laterally connected to the base portion 23 and covers the second stepped portion 62, the first abutting portion 21, the base portion 23 and the sleeve portion 13 define an interior space 27, and the elastic member 53 is received in the interior space 27. Therefore, the first abutting portion 21 can protect a structure of the elastic member 53 and prevent the elastic member 53 from being influenced by impacts from outside during transformation or movement so as to ensure the switch member 2 to move axially smoothly.

Still more preferably, the switch member 2 further has an anti-slip structure 52 which is integrally formed on the outer surface of the switch member 2, and the anti-slip structure 52 is for a finger 8 to press or contact thereon so as to increase a stability of the finger 8 controlling the switch member 2. Moreover, the exterior circumferential wall 25 of the switch member 2 further has at least one recess 26, and the second receiving portion 32 is formed on the recess 26, when the finger 8 presses the recess 26 to operate the switch member 2, the recess 26 increase a contact area of the finger 8 and the switch member 2 so as to elevate an operating stability. In this embodiment, a number of the at least one recess 26 is one, and the recess 26 is a circumferential groove.

In addition, the sleeve portion 13 further has two penetrating holes 132, the two penetrating holes 132 are symmetrical to each other with the axis 11 as a center for more connection ways. For example, but not limited thereto, when two said second receiving portions 32, which have through holes, respectively correspond to the two penetrating holes 132, a pin can be inserted through the socket and the inserting portion 71 to connect the socket and the inserting portion 71, or the socket can be positioned on a tool card in this way.

Specifically, the socket main body 1 further includes a circumferential band region 133 which has a width equal to a diametric dimension of the first receiving portion 31 and within which the first receiving portion 31 is located. When the switch member 2 axially moves relative the socket main body 1 so that the second receiving portion 32 radially corresponds to and within the circumferential band region 133 and when the switch member 2 is rotated so that the second receiving portion 32 does not overlap with the first receiving portion 31, the switch member 2 makes the part of the positioning member 33 non-retractably protrude within the receiving space 131 for positionably engaging with the positioning portion 72. This can totally avoid unexpected disengagement of the socket from the driving tool and avoid inadvertent danger to the user.

Given the above, the socket has a simple structure and is easy to be operated, the user only needs to rotate and move the switch member to the released position, and then the socket can be quickly sleeved to the inserting portion of the driving tool. In addition, after the finger is removed from the switch member, the elastic member can quickly push the switch member to move and make the first and second receiving portions offset relative to each other and maintain on the locked position. Besides, the user can further rotate the switch member to make the first receiving portion correspond to the second receiving hole precisely without being driven by an exterior force easily so as to prevent slippery.

While we have shown and described various embodiments in accordance with the present invention, it should be clear to those skilled in the art that further embodiments may be made without departing from the scope of the present invention.

What is claimed is:

1. A socket, for being sleeved to an inserting portion of a driving tool, at least one positioning portion being recessed on the inserting portion, the socket including:

a socket main body, having an axis and a working portion and a sleeve portion which are disposed along an extending direction of the axis, the working portion for being connected to a fastening member, the sleeve portion having a receiving space which is for the inserting portion to insert thereinto;

a switch member, movable along the extending direction of the axis, disposed to the sleeve portion, and freely rotatable about the socket main body;

at least one positioning unit, including a first receiving portion, a second receiving portion and a positioning member, the first receiving portion penetrating through the sleeve portion and being lateral to the axis, the second receiving portion being formed on the switch member and facing the sleeve portion, the positioning member being movably received in the first receiving portion, a part of the positioning member protruding beyond the first receiving portion;

wherein when the switch member is on a locked position, the first receiving portion and the second receiving portion axially offset relative to each other, and the switch member makes a part of the positioning member non-retractably protrude within the receiving space for positionably engaging with the positioning portion; when the switch member is on a released position, the first receiving portion and the second receiving portion overlap with each other on a direction lateral to the axis in a manner that a part of the positioning member protrudes within the second receiving portion without protruding within the receiving space;

wherein the first and second receiving portions are respectively a through hole, and the second receiving portion is smaller than the first receiving portion in hole dimension;

wherein the socket main body further includes a circumferential band region which has a width equal to a diametric dimension of the first receiving portion and within which the first receiving portion is located;

wherein when the switch member axially moves relative the socket main body so that the second receiving portion radially corresponds to and within the circumferential band region and when the switch member is rotated so that the second receiving portion does not overlap with the first receiving portion, the switch member makes the part of the positioning member non-retractably protrude within the receiving space for positionably engaging with the positioning portion;

wherein the socket further including a position-restricting member, the position-restricting member is positioned on the sleeve portion, the working portion is greater than the sleeve portion in outer diameter dimension, a first stepped portion is formed between the working portion and the sleeve portion; on a direction parallel to the axis, the first stepped portion and the position-restricting member have a predetermined distance therebetween, the switch member is positioningly restricted between the first stepped portion and the position-restricting member; and the predetermined distance is greater than a length of the switch member on the direction parallel to the axis;

wherein two opposite sides of the switch member have a first abutting portion and a second abutting portion, and on the direction parallel to the axis, the first abutting portion is located between the second abutting portion and the first stepped portion; after the switch member is rotated to allow the first receiving portion to be linearly arranged relative to the second receiving portion on the direction parallel to the axis, when the first abutting portion abuts against the first stepped portion, the switch member is on the released position, and when the second abutting portion abuts against the position-restricting member, the switch member is on the locked position;

wherein the sleeve portion further has a second stepped portion, the switch member further has a base portion, and two ends of an elastic member respectively abut against the second stepped portion and the base portion to make the second abutting portion move toward the position-restricting member normally;

wherein the socket main body has a first marking portion, and the first marking portion corresponds to the first receiving portion on the direction parallel to the axis; the switch member has a second marking portion, and the second marking portion corresponds to the second receiving portion on the direction parallel to the axis; an exterior circumferential wall of the switch member further has at least one recess, and the second receiving portion is formed on the at least one recess; the switch member further has an anti-slip structure, and the anti-slip structure is for a finger to press or contact thereon; the switch member is sleeved on the sleeve portion, and a distance between an exterior circumferential wall of the switch member to the axis is substantially equal to a distance between an exterior circumferential wall of the working portion to the axis; a number of the at least one positioning portion is two, the two positioning portions are openings which are symmetrical to each other and communicable with each other, a number of the at least one positioning unit is two, the two positioning units are symmetrical to each other with the axis as a center, and when the switch member is on the locked position, two said positioning members are respectively engaged into the two positioning portions; on the direction parallel to the axis, a length of the sleeve portion is substantially 0.4 to 0.6 times of a length of the working portion; the sleeve portion further has two penetrating holes, the two penetrating holes are symmetrical to each other with the axis as a center; the position-restricting member is a ring which is fastened on the sleeve portion; the switch member further has a cover portion, the cover portion is laterally connected to the second abutting portion, and when the second abutting portion abuts against the position-restricting member, the cover portion covers the position-restricting member on a direction lateral to the axis; the positioning member is a ball; the first abutting portion is laterally connected to the base portion and covers the second stepped portion, the first abutting portion, the base portion and the sleeve portion define an interior space, and the elastic member is received in the interior space; and a number of the at least one recess is one, and the recess is a circumferential groove.

* * * * *